United States Patent [19]

Hurko

[11] 4,032,750

[45] June 28, 1977

[54] FLAT PLATE HEATING UNIT WITH FOIL HEATING MEANS

[75] Inventor: Bohdan Hurko, Louisville, Ky.

[73] Assignee: General Electric Company, Louisville, Ky.

[22] Filed: Mar. 26, 1976

[21] Appl. No.: 670,702

[52] U.S. Cl. ..... 219/464; 219/460; 219/461; 219/463; 219/544

[51] Int. Cl.[2] ..... H05B 3/68

[58] Field of Search ..... 219/345, 459, 460, 461, 219/462, 463, 464, 467, 538, 543, 544

[56] References Cited

UNITED STATES PATENTS

| | | | |
|---|---|---|---|
| 3,067,315 | 12/1962 | Hurko | 219/543 |
| 3,086,101 | 4/1963 | Scofield | 219/460 |
| 3,496,336 | 2/1970 | Hingorany et al. | 219/464 |
| 3,591,753 | 7/1971 | Gartner | 219/464 |
| 3,646,321 | 2/1972 | Siegla | 219/464 |
| 3,733,462 | 5/1973 | Bouchard et al. | 219/464 |
| 3,789,189 | 1/1974 | Fischer et al. | 219/464 |
| 3,845,273 | 10/1974 | Hurko | 219/462 |
| 3,869,596 | 3/1975 | Howie | 219/464 X |
| 3,883,719 | 5/1975 | Hurko | 219/464 |
| 3,936,660 | 2/1976 | Blackwood | 219/459 |

*Primary Examiner*—Volodymyr Y. Mayewsky
*Attorney, Agent, or Firm*—Richard L. Caslin; Francis H. Boos

[57] ABSTRACT

A flat plate surface heating unit with a utensil-supporting cover plate provided with a separate, flexible, insulation sheet supporting a resistive foil heater that is seated on a pad of dielectric material in a reinforced reflector pan. Constant upward pressure is exerted to maintain the insulation sheet with foil heater in full contact with the underside of the cover plate.

9 Claims, 4 Drawing Figures

FIG.1
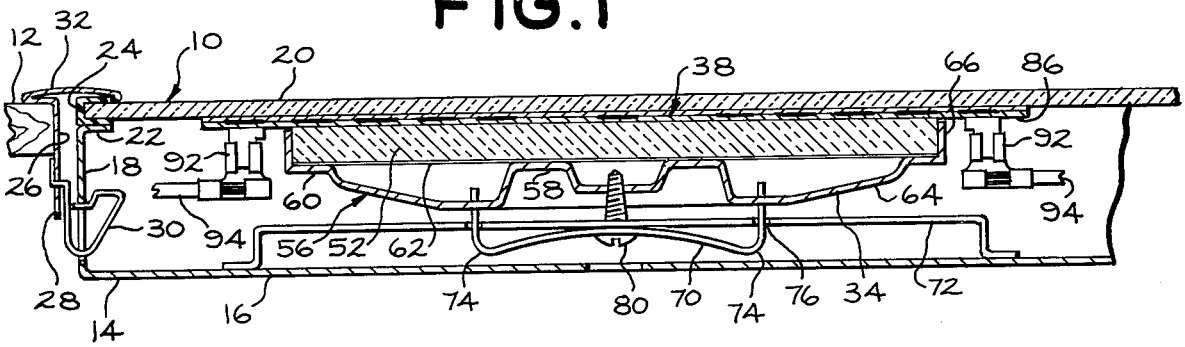
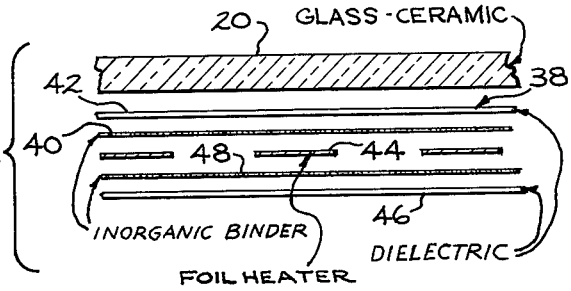
FIG.4
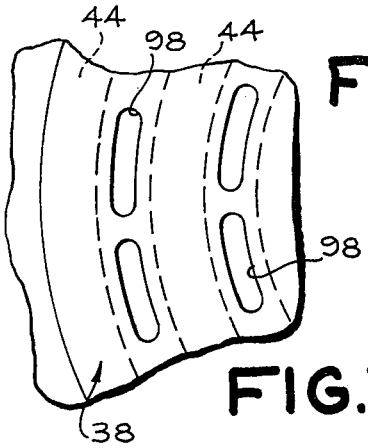
FIG.3
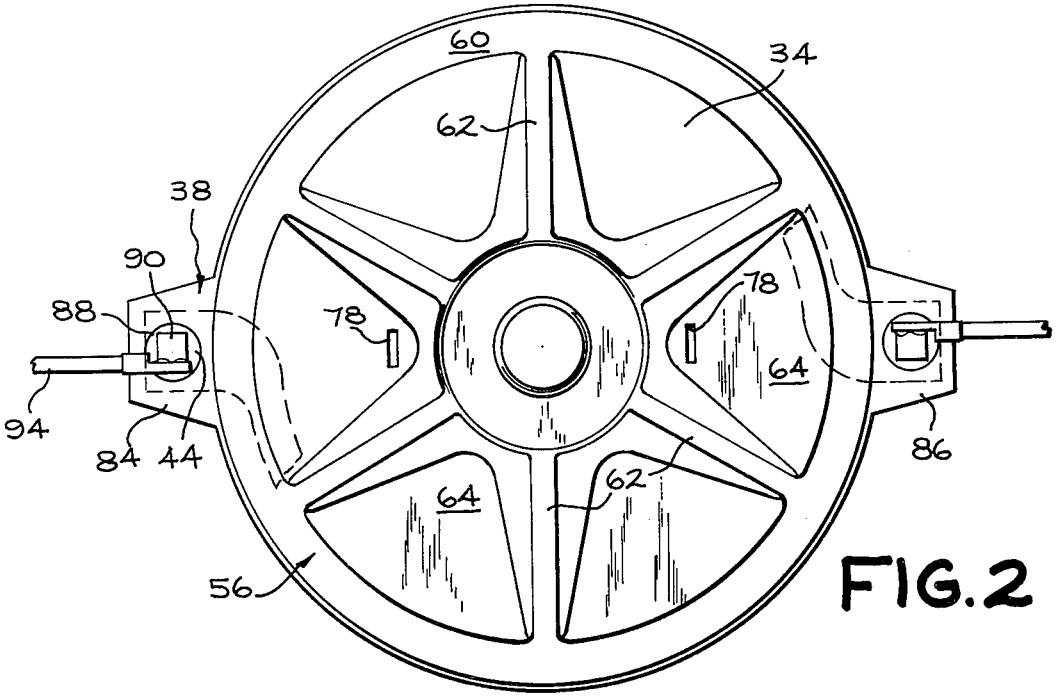
FIG.2

FLAT PLATE HEATING UNIT WITH FOIL HEATING MEANS

BACKGROUND OF THE INVENTION

1. Field of the Invention

This invention relates to the electric range art and particularly to the use of foil heaters with a solid utensil-supporting cover plate.

2. Description of the Prior Art

Solid plate surface heating units have been provided in the past with glass-ceramic plates having film heaters of noble metal bonded directly to the underside of the plates. Three examples of glass-ceramic heating units using film heaters are shown in the Hurko U.S. Pat. Nos. 3,067,315 and 3,883,719, both assigned to the present assignee, and in the Brouneus U.S. Pat. No. 3,813,520. Such film heaters are of serpentine shape, and they are bonded directly to the plate. They provide a most efficient heating system for glass-ceramic surface heating units or cooktops because the film strips have a very low thermal mass and good thermal coupling with the plate, resulting in quicker response to heat-up and cool-down conditions. The film heater stores very little heat, and it radiates very little heat in a downward direction because of its low emissivity surface. One disadvantage of the film heater designs for solid plate surface heating units is the relatively high cost of film materials because they are of noble metals, such as gold and platinum.

Etched foil heaters for use with solid plate surface heating at low temperatures below about 450° F have been available before this invention from Safeway Products, Inc. of Middletown, Conn. They are highly reliable at relatively low temperatures, and their cost is a great deal below film heaters. An example of etched foil heaters is given in the Howie U.S. Pat. No. 3,869,596, which is assigned to Safeway Products, Inc. This patent shows a glass-ceramic plate with an etched foil heater bonded between two layers of dielectric material, and this heating element is bonded directly to the underside of the glass-ceramic plate, and, as stated in this Howie patent, it has an anticipated operating temperature on the order of 450° F.

In experimenting with high-temperature applications for etched foil heaters, we made improvements by eliminating the bonding of the laminated foil heating directly to the glass-ceramic plate. The bonding action was a deterrent because it limited the kind of foil material used to a low thermal expansion metal foil so as to be able to match the coefficient of thermal expansion of the glass-ceramic plate, and this in turn limited the application of foil heaters to a low temperature range having a maximum of about 450° F.

Moreover, prior art foil heaters used a flexible, thermosetting, organic adhesive to make a strong bond, which again limited the foil heater to a low temperature range. At higher temperatures, such adhesive would carbonize and cause short circuits between the turns of the foil heater as was experienced during the tests.

The principal object of the present invention is to provide a solid plate surface heating unit with a separate, flexible, insulated foil heater for use at high temperatures in the vicinity of 1250° F.

A further object of the present invention is to provide a solid plate surface heating unit of the class described with means to allow the resistive foil heater to freely expand at operating temperatures with relation to its supporting laminations of insulation.

A further object of the present invention is to provide a solid plate surface heating unit of the class described with means to exert a constant pressure against the insulated foil heater to hold it firmly against the underside of the plate and prevent it from separating from the plate at high operating temperatures.

A further object of the present invention is to provide a solid plate surface heating unit of the class described with a thin, high-quality, insulating support pad to raise the thermal efficiency of the surface heating unit. In turn, the support pad is braced by a reinforced reflector pan that prevents the support pad from sagging at high operating temperatures.

SUMMARY OF THE INVENTION

The present invention, in accordance with one form thereof, relates to a flat plate surface heating unit with a utensil-supporting cover plate, and a separate, thin, flexible, insulated foil heater resting on a support pad of dielectric material that is seated in a reinforced reflector pan. A constant upward pressure is used on the assembly to press the insulated foil heater into good thermal coupling relationship with the underside of the cover plate.

BRIEF DESCRIPTION OF THE DRAWINGS

This invention will be better understood from the following description taken in conjunction with the accompanying drawings, and its scope will be pointed out in the appended claims.

FIG. 1 is a fragmentary cross-sectional elevational view through a glass-ceramic cooktop having a separate insulated foil heater, and also showing the associated parts of the present invention.

FIG. 2 is a bottom plan view of the reinforced reflector pan of the present invention, as well as showing the two terminals of the insulated foil heater located at opposite sides of the assembly.

FIG. 3 is a fragmentary view of a modification of the insulated foil heater showing elongated cutouts in the insulation between adjacent turns of the foil heater so as to provide the foil heater with more freedom of movement under high-temperature operating conditions.

FIG. 4 is a fragmentary exploded view in cross-section of the cover plate and the laminations of the insulated foil heater.

DESCRIPTION OF THE PREFERRED EMBODIMENTS

Turning now to a consideration of the drawings, and in particular to FIG. 1, there is shown a portion of an electrically heated glass-ceramic cooktop 10 that is shown built into a kitchen countertop 12. It will be understood that this invention could also be used in a cooktop assembled over the oven of an electric range, or used as a single surface heating unit or hotplate. The cooktop 10 has a shallow mounting box or rough-in box 14 having a bottom wall 16, vertical side walls 18, and an open top which is adapted to be closed by a thin, utensil-supporting, glass-ceramic plate 20, which may be a large single plate for accommodating four heating units, or a series of either two medium plates or four smaller individual plates. Such glass-ceramic plate material is crystalline glass, generally opaque, of milk-white appearance, of lithia-alumina silicates having a very low coefficient of thermal expansion. Examples of such material are sold under such trademarks as PYROCERAM, CER-VIT and HERCUVIT. This glass-ceramic plate 20 has a smooth top surface of almost ground glass appearance, and it is readily cleanable. The plate does not permit the drainage of spillovers therebeneath, as in standard cooktops using coils of metal sheathed electric resistance heating elements. While a glass-ceramic plate 20 is shown, it will be understood by those skilled in this art, that such a solid plate could be of metal or other high-temperature resisting material without departing from the scope of the present invention.

A peripheral ledge or flange 22 around the top edge of the vertical walls 18 of the rough-in box 14 serves as a support means for the glass plate 20, and there may be other support ledges near the center of the box, as needed. The peripheral edge of the glass plate 20 is provided with a resilient gasket 24 for protecting the edge and serving as a resilient seat and moisture barrier. A trim frame 26, of T-shaped transverse cross-section, encircles the periphery of the box 14 and serves as a support means for the box in an opening of the countertop 12, as is conventional in this art. The vertical portion 28 of the trim frame 26 is adapted to be fastened to the vertical walls 18 of the rough-in box by means of a series of widely-spaced spring clips 30. The top crown 32 of the T-shaped trim frame 26 has its innermost half overlying the peripheral edge of the glass plate 20, and its outermost half adapted to overlie a peripheral edge of a kitchen countertop 12 that forms an opening for receiving the cooktop 10 therein. Suitable hold-down clamps (not shown) would be used to anchor the cooktop in place. If this cooktop 10 were to be assembled with an electric oven to form a complete range, then the mounting means for the glass plate would be altered accordingly, as would be clear to those skilled in this art.

The cooktop 10 may have a plurality of heating means. The number of four is more or less standard in the electric range art. For the purpose of illustrating the present invention, only one surface heating unit 34 is shown, as in FIG. 1. The surface unit 34 has a heating means 38 in the form of a thin, flexible, dielectric sheet 42 supporting an etched resistive foil heater 44, as is best seen in FIG. 4. The thin dielectric sheet 42 is adapted to be positioned against the underside of the cover plate 20. A resistive foil heater 44 of coiled configuration is adhesively bonded by an inorganic binder 40 to the dielectric sheet 42. Another modification would be to employ a second dielectric sheet 46 beneath the first dielectric sheet 42, and adhesively bonding the two sheets together by means of an inorganic binder 48. Suitable inorganic binders have proved to be either sodium, potassium, or aluminum silicates, which are capable of withstanding temperatures having a maximum limit in the vicinity of 1250° F, although, at these temperatures, the binder forms a rather weak bond between the dielectric sheets 42 and 46 and the foil heater coil 44. This rather weak bond is a positive characteristic of the heating means 38 in that it allows for free expansion of these several components, such that the foil heater coils stay evenly spaced and the laminated heater assembly 38 does not warp or move away from the glass-ceramic plate 20 at the high operating temperatures.

The foil heater 44 is a thin foil on the order of 0.002 inches, etched from stainless steel or Nichrome foil in a coiled configuration, similar to those used with film heaters. The foil heater coil is bound to the dielectric sheets 42 and 46 for protection purposes and ease in handling. These dielectric sheets may be ceramic paper, or fiber glass cloth, or Micamet sheets of insulation that are about 0.010 inches thick, such that the entire assembly of foil heater 44 and the upper and lower dielectric sheets 42 and 46 result in a sandwich that is wafer thin, as well as being flexible, in order to conform to the undersurface of the glass-ceramic plate 20.

The heating means 38 is supported on a pad of dielectric material of high insulating quality, such as Microtherm. This insulating pad 52 is seated in a reinforced reflector pan 56 which is generally of the shape best seen in FIG. 2. FIG. 2 is an inverted view of the pan 56, in effect looking at the bottom side of the pan. The reason the pan is reinforced is that, if it had a simple, flat bottom wall, it would not be strong and it would tend to have an "oil can" effect at high operating temperatures. The purpose of the pan is to support the insulating pad 52 and exert a constant upward pressure against the heating means 38 to hold the heating means tightly against the underside of the cover plate 20. This all must be done at relatively high temperatures that reach as high as 250° F, and there is a tendency for metal to expand and contract due to variations in temperatures.

The pan 56 is reinforced or embossed such that it will have a rigid construction. The pan 56 is generally circular in shape and it has a flat central area 58, a narrow peripheral area 60 in the same horizontal plane as the central area 58, and a series of radial arms 62 connecting the central area 58 with the peripheral area 60 and positioned in the same horizontal plan therewith. In between the radial arms 62 are depressions or embossments 64 which serve to strengthen the pan and make it more rigid. Thus the surfaces 58, 62 and 60 are in direct contact with the underside of the insulating pad 52. The periphery of the pan is provided with a vertical edge 66 to enclose the insulating pad 52 so as to form a heat barrier against heat flow in a downward direction from the heating means 38. The vertical edge 66 stops short of the heating means 38 so as not to touch the heating means.

It is well to exert a constant upward pressure against the heating means 38 through the insulating pad 52 and the reflector pan 56 because the cover plate 20 serves as a heat sink and draws off heat from the heating means 38. If there were a poor thermal coupling between the heating means 38 and the cover plate 20, there could be local overheating of the heating means, poor thermal efficiency and a shortened life of the foil heater. This is due to the difference in coefficient of thermal expansion between the foil heater coil 34 and the dielectric sheets 42 and 46 of Micamet, or the like. These difficulties can be avoided if the heating means 38 is pushed firmly against the cover plate 20, and the thermal efficiency is much higher. A suitable force is somewhere between 5 pounds and 25 pounds of pressure on a 6-inch diameter surface heating unit. This amount of pressure will allow good thermal coupling between the heating means and the cover plate, yet it will allow free expansion of the foil heater if necessary. The upward pressure is provided by a leaf spring 70 which is fastened to a brace 72 that is attached to the bottom wall 16 of the rough-in box 14. The spring 70 is of thin spring stock and it has two upturned ends 74 which extend through enlarged openings 76 in the brace and are fastened into openings 78 in the bottom wall of the reflector pan 56. A fastening screw 80 extends through the center of the spring 70 and is threaded into an opening in the brace. The screw extends into an oversized opening in the reflector pan 56. So as not to allow the screw 80 to injure the insulating pad 52, the center 79 of the area 58 of the reflector pan is depressed slightly, as best seen in FIG. 1. Thus, when the fastening screw 80 is tightened, the spring 70 bows upwardly in the center, and the two ends 74 exert pressure upwardly against the reflector pan 56.

The two terminals 84 and 86 of the foil heater 44 are shown at opposite sides of the surface unit, as best seen in FIGS. 1 and 2. The configuration of the foil heater 44 is not shown in detail but it is generally of coiled configuration, starting at the periphery of the heating means 38 until it reaches the center where it doubles back on itself and has a reverse spiral going in the opposite direction generally parallel with the first spiral but terminating at the diametrically opposite side of the heating means 38. This specific coiled configuration is generally well known and does not form part of the present invention. It is well to recognize that the width of the foil heater 44 is increased at the terminals in order to reduce the operating temperature at the terminals, as is best seen in FIG. 2. The heating means 38 is formed with outer tabs 86 of the dielectric sheets 42 and 46. An enlarged opening 88 is formed in the bottom dielectric sheet 46 so as to expose the foil heater 44 so that a terminal blade 90 may be welded to the foil heater so that a push-on connector 92 may be fitted onto the tab for making an electrical connection therewith, as is best seen in FIGS. 1 and 2. Lead wires 94 are crimped to the connector 92, as is standard in this art.

A modification of the heating means 38 is shown in the fragmentary view of FIG. 3, which is of the flexible heating means 38. There are elongated cutouts 98 formed in the heating means 38 between the coils of the foil heater 44 so as to make the heating means more flexible and allow for free expansion of the foil heater at high temperatures without allowing the heating means to warp or separate from the cover plate 20. Hence, the cover plate 20 is always serving as a heat sink and preventing the heating means 38 from being overheated.

Modifications of this invention will occur to those skilled in this art; therefore, it is to be understood that this invention is not limited to the particular embodiments disclosed, but that it is intended to cover all modifications which are within the true spirit and scope of this invention as claimed.

What is claimed is:

1. A flat plate surface heating unit comprising:

an upper utensil-supporting cover plate of heat-conductive material;

a thin flexible layer of dielectric heat-conductive material positioned against the underside of the cover plate but not bonded thereto;

resistive foil means adhesively bonded to the underside of the dielectric layer by a high-temperature inorganic binder;

a support pad of dielectric non-heat-conductive material positioned beneath the foil means;

a reinforced reflector pan firmly supporting the dielectric pad;

and constant pressure means supported with respect to the cover plate and applying upward pressure against the reflector pan to assure good contact and thermal coupling between the resistive foil means through the thin dielectric layer to the cover plate.

2. The invention of claim 1 wherein the high-temperature inorganic binder is selected from one of the class of sodium, potassium and aluminum silicates.

3. The invention of claim 1 wherein a second thin flexible layer of dielectric heat conductive material is adhesively bonded to the underside of the resistive foil means and to the first dielectric layer to form a flexible laminated heating element, wherein the adhesive bonding material is an inorganic binder that is capable of withstanding temperatures in the vicinity of 1250° F., and the binder forms a relatively weak bond during operation of the heating element so as to allow free expansion and contraction of the resistive foil means during operation.

4. The invention of claim 1 wherein the said support pad of dielectric non-heat-conductive material is under a compressive force of between 5 and 25 pounds to insure good contact between the resistive foil means and its thin layer of dielectric material with the cover plate.

5. The invention of claim 3 wherein the said inorganic binder is selected from one of the group of sodium, potassium and aluminum silicates.

6. The invention of claim 5 wherein the said support pad of dielectric non-heat-conductive material is under a compressive force of between 5 and 25 pounds to insure good thermal coupling between the flexible laminated heating element and the cover plate.

7. The invention of claim 6 wherein the said reinforced reflector pan has an embossed bottom wall with a generally flat central section, a plurality of generally flat radial arms and a generally flat peripheral section joining the radial arms, all of said flat surfaces to be in contact with the said support pad, the said flat radial arms being separated by depressions which serve to reinforce the bottom wall of the pan and prevent it from warping.

8. The invention of claim 7 wherein the said flexible laminated heating element has the resistive foil means arranged in a closely spaced spiral configuration, selected portions of the two thin layers of dielectric material between adjacent turns of the spiral resistive foil means being formed with elongated cutouts so as to provide the spiral foil means with more freedom of movement under high-temperature operating conditions.

9. A flat plate surface heating unit comprising:

an upper utensil-supporting cover plate of heat-conductive material;

a flexible heating element of resistive foil means encapsulated within a thin flexible mass of dielectric heat-conductive material that is positioned against the underside of the cover plate but not bonded thereto;

a support pad of dielectric non-heat-conductive material positioned against the underside of said flexible heating element;

a reinforced reflector pan firmly supporting the dielectric pad;

and constant pressure means supported with respect to the cover plate and applying upward pressure against the reflector pan to assure good contact and thermal coupling between the flexible heating element and the cover plate.

* * * * *